US009822955B2

(12) United States Patent
Mayo

(10) Patent No.: US 9,822,955 B2
(45) Date of Patent: Nov. 21, 2017

(54) BREAKAWAY CONNECTOR AND FUSE RECEPTACLE

(71) Applicant: Ilsco Corporation, Cincinnati, OH (US)

(72) Inventor: Stephen K. Mayo, West Chester, OH (US)

(73) Assignee: Ilsco Corporation, Cincinnati, OH (US)

( * ) Notice: Subject to any disclaimer, the term of this patent is extended or adjusted under 35 U.S.C. 154(b) by 113 days.

(21) Appl. No.: 14/990,892

(22) Filed: Jan. 8, 2016

(65) Prior Publication Data

US 2016/0204541 A1 Jul. 14, 2016

Related U.S. Application Data

(60) Provisional application No. 62/101,412, filed on Jan. 9, 2015.

(51) Int. Cl.

| | |
|---|---|
| ***F21V 21/10*** | (2006.01) |
| ***H01R 13/68*** | (2011.01) |
| ***H01R 13/635*** | (2006.01) |
| ***F21V 23/06*** | (2006.01) |
| ***F21V 25/04*** | (2006.01) |
| ***H01H 85/22*** | (2006.01) |
| ***H01R 4/36*** | (2006.01) |
| *F21S 8/08* | (2006.01) |
| *F21W 131/103* | (2006.01) |

(52) U.S. Cl.

CPC ..... *F21V 21/10* (2013.01); *F21V 23/06* (2013.01); *F21V 25/04* (2013.01); *H01H 85/22* (2013.01); *H01R 4/36* (2013.01); *H01R 13/635* (2013.01); *H01R 13/68* (2013.01); *F21S 8/086* (2013.01); *F21W 2131/103* (2013.01)

(58) Field of Classification Search

CPC ..... H01H 85/22
USPC ..... 362/431; 439/474–475, 289, 797, 810, 439/923, 620.29

See application file for complete search history.

(56) References Cited

U.S. PATENT DOCUMENTS

| | | | | |
|---|---|---|---|---|
| 3,611,274 | A | 10/1971 | Low et al. | |
| 3,753,192 | A | 8/1973 | Urani | |
| 3,761,865 | A | 9/1973 | Bomgaars et al. | |
| 4,138,181 | A | 2/1979 | Hacker et al. | |
| 4,801,278 | A | 1/1989 | Sappington | |
| 4,863,397 | A | 9/1989 | Hatch, Jr. | |
| 4,909,761 | A * | 3/1990 | Muguira | H01H 85/201 337/201 |

(Continued)

*Primary Examiner* — Andrew Coughlin
*Assistant Examiner* — Michael Chiang
(74) *Attorney, Agent, or Firm* — Wood Herron & Evans LLP

(57) ABSTRACT

A mast lighting system of the type including at least one mast having a proximate end and an opposite distal end, the distal end capable of supporting an electrical component and the proximate end mounted to a foundation that has at least a portion extending into the ground, an electrical cable within the mast connecting the electrical component to a distribution component assembly through a breakaway electrical connector, and a power source connected to the distribution component assembly. The breakaway electrical connector including a fuse in a first part and a fuse clip in a second part forming the breakaway connection between the two parts of the electrical connector.

22 Claims, 5 Drawing Sheets

(56) References Cited

U.S. PATENT DOCUMENTS

| | | | | |
|---|---|---|---|---|
| 5,267,880 | A | 12/1993 | Tamm | |
| 5,335,160 | A | 8/1994 | Savoca | |
| 5,427,542 | A | 6/1995 | Gerow | |
| 5,533,912 | A * | 7/1996 | Fillinger | H01R 13/5213 439/521 |
| 5,993,246 | A | 11/1999 | Moldenhauer et al. | |
| 6,303,857 | B1 | 10/2001 | Ginsburg | |
| 6,872,883 | B2 | 3/2005 | Ginsburg | |
| 8,454,390 | B2 | 6/2013 | Darr et al. | |
| 8,517,768 | B2 | 8/2013 | Blaha et al. | |
| 2004/0037084 | A1 * | 2/2004 | Ginsburg | E04H 12/003 362/431 |
| 2013/0037294 | A1 * | 2/2013 | Blaha | H01H 85/0026 174/50 |

* cited by examiner

BREAKAWAY CONNECTOR AND FUSE RECEPTACLE

This claims the benefit of U.S. Provisional Patent Application Ser. No. 62/101,412, filed Jan. 9, 2015 and hereby incorporated by reference in its entirety.

BACKGROUND OF THE INVENTION

This invention relates to the general field of electrical connectors and is particularly concerned with outdoor mast lighting systems.

Mast lighting systems are well known and commonly support a light above the surface to be lighted with a long pole or mast. Masts are typically hollow, and may be round, square or of any selected cross-sectional shape which provides adequate stability. The mast may include a breakaway base at its lower end having an opening (or "handhole") therein, through which the interior of the mast may be accessed by maintenance or installation personnel. The mast is typically mounted on a foundation of concrete or other suitable material set permanently into the ground and may be affixed to the foundation by a plurality of anchor bolts set into the foundation, which engage corresponding holes in the breakaway base.

Suspended at the top of the mast is an electrical component, commonly an electric light. In some applications, a cantilevered secondary mast or arm supports the light over a street or sidewalk. In other applications, a ring of high-intensity lamps may be supported radially around the distal end of the mast. The electrical component is electrically connected to a power source, generally in series with a number of other commonly powered mast units in a given area.

Power delivery to each light in a commonly powered system has been accomplished in a variety of ways. In one such system, the output of a master circuit breaker may be connected to an electric power cable which runs to the base of the mast. The power cable may connect to a fuse and surge arrestor assembly disposed within the hollow mast, which prevents current surges caused by lightning, voltage spikes or other anomalies from damaging the light fixture or the master circuit breaker. Access to the fuse and surge arrestor assembly is commonly provided by locating that assembly adjacent a handhole in the mast.

The performance of such a system is impaired by several shortcomings. Wire and cable attachments are generally made by splices, which are vulnerable to failure when tensile forces are applied to the connections.

In the event of an impact, the mast is often sheared off at the base and commonly comes to rest several yards from its original position. As is evident, the electrical circuit within the mast must be provided with means of disconnect which will allow the load side to separate from the line side by means of suitable tension applied to the load side conductors in the event a mast knockdown were to occur due to impact from a vehicle, thus preventing the feeder circuit being unearthed or broken; disrupting power to the rest of the circuit, which would be very important in the event of a nighttime accident; leaving broken or frayed electrical conductors exposed providing potential for electrocution to persons at the accident site; and energized electrical wires falling into traffic or the accident vehicle(s). In addition to these features, a fuse should be provided for protection of the load circuit, and in the event of a problem in the load circuit, the fuse would open, leaving the remainder of the lighting circuit energized.

Of particular importance, since this type of connector must be accessible for maintenance, is that the fuse be installed in such a manner that maintenance personnel are at no risk of electrical shock during fuse inspection or replacement. A further requirement for this application is that the connector be watertight, as certain conditions could occur, causing the connector to be submersed in flood water. Further, the connector should be easily assembled and serviced by technicians and capable of being capped on-site in the event of a mast knockdown.

SUMMARY OF THE INVENTION

These and other shortcomings in the prior art have been addressed by one or more embodiments of this invention which includes an electrical connector which will separate safely upon impact or tension of the adjoining wired connections. In various embodiments, the connector may be fused or unfused depending upon the particular application.

Roadway lighting masts or poles are mandated to breakaway at the base during impact. This type of light pole also requires an inline breakaway connector to be installed. This invention in various embodiments is such an inline breakaway connector which may be used in such settings. Additionally, fusing these connectors helps prevent any unintended electrocution. It is estimated that of the approximately 60 million street lights in the U.S.A., 26 million are roadway lighting and subject to breakaway regulations.

Connectors according to this invention may also be utilized for roadway lighting, parking lighting, electric vehicle charging stations, solar installations, traffic signals, lighted signage, LED conversion, sports lighting, and marine lighting to name just a few non-limiting examples.

The breakaway connector according to various embodiments of this invention may be utilized without allowing for voltage exposure. In various embodiments, mechanical screws are used to lock a fuse in place to the load side of the connector thereby providing a safer connection than with many prior art breakaway connectors. This invention also is easier to install because it includes fewer parts and therefore takes less time and space for installation. Moreover, it also minimizes the chance of incorrect installation. Conductors or stranded wires are inserted into the connector for easier installation and assembly. Various embodiments of this invention are also water resistant or waterproof.

Various embodiments of the connector according to this invention include caps which could be used to seal or isolate voltage and prevent inadvertent electrocution after a light pole impact or separation. The caps may be tethered to the entry points for the conductors and after impact, the cap may be removed and placed on the line side open to a voltage exposure. The same cap may also be used for sealing set screw access to the connector.

According to various embodiments, the connector of this invention utilizes two independent components which have modular design with the ability to be configured into six or more different products. This allows the connector to be converted in the field should regulations change from a non-breakaway device to a breakaway device with the addition of only one or a minimal number of parts. This connector may be utilized underground or in a submersible environment, allows for range taking and breakaway operation and may include a fuse, if appropriate. This connector may be manufactured from high-strength, 6061-T6 aluminum alloy and be rated for boo volts as well as certified for direct burial in earth or concrete and submersion applications and meet or exceed UL486A, B, D and ANSI 119.1 and 119.4 specifications.

These and other aspects of various embodiments of this invention overcome the shortcomings of the prior art and are shown in more detail in the accompanying drawings and following detailed description.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION OF THE INVENTION

Figure 1:
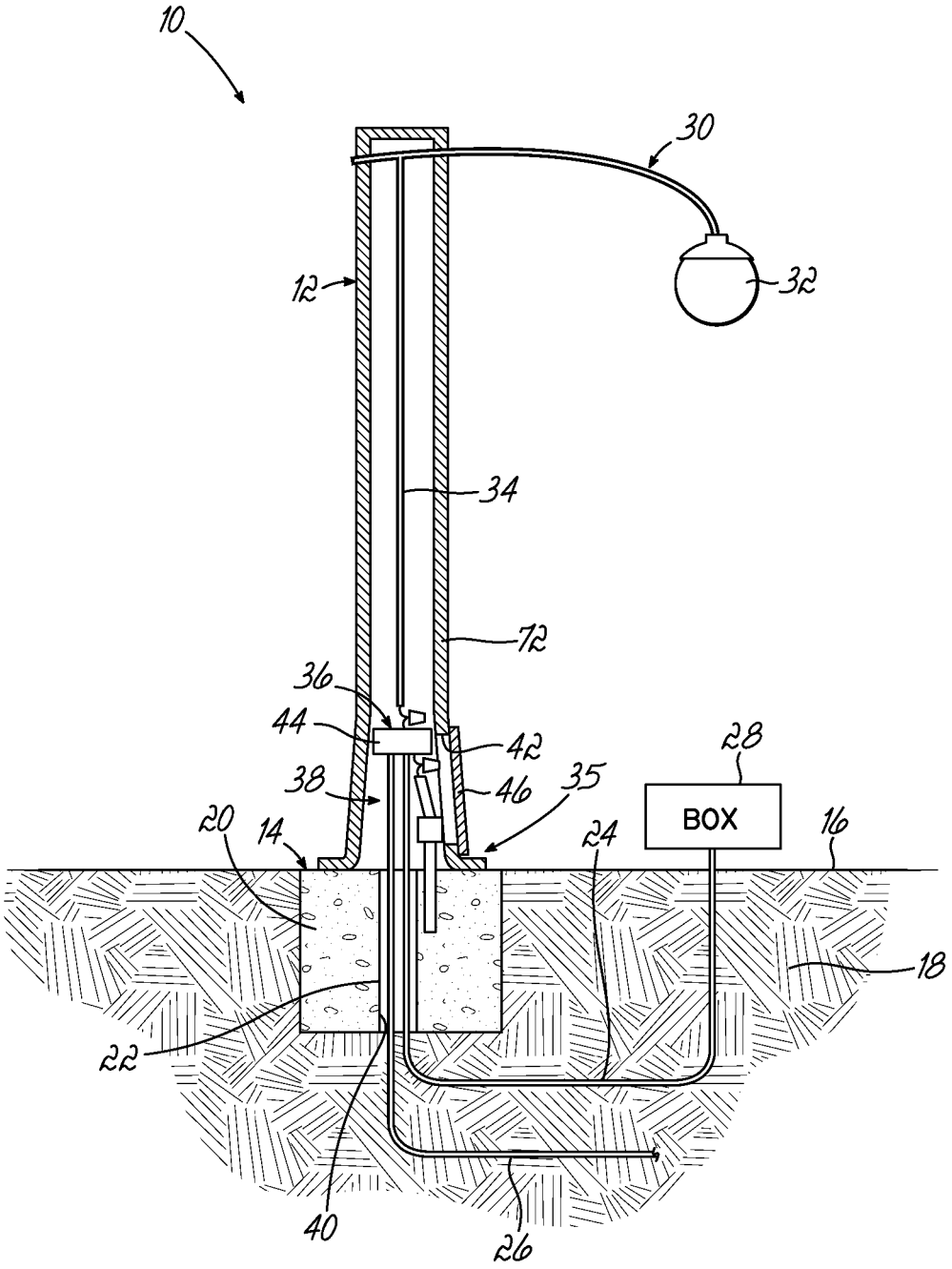
FIG. 1 is a cross-sectional schematic view of a breakaway light pole installation in which various embodiments of this invention may be used.

Referring first to FIG. 1, a mast lighting system 10 is shown, of the type having at least one mast 12 mounted to a foundation 14. At least part of the foundation 14 extends below the grade 16 of the surrounding ground 18, whether installed in a parking lot, highway shoulder, sidewalk, or other environment. The foundation 14 commonly includes a pedestal 20 of concrete, but may be constructed of other materials capable of providing a stable base for the lighting system 10. The horizontal upper surface of the pedestal 20 may be at or above the level of the surrounding grade 16. The pedestal 20 may be poured around a central conduit 22 through which underground electrical feeder wires 24, 26 extend. The incoming feeder wires 24 convey electrical power to the lighting unit, either from a common power source (a remote circuit breaker box 28) or from the outgoing feeder wires 26 of an adjacent lighting unit (not shown).

The mast 12 is rigidly attached to the pedestal 20 by welding, by a plurality of anchor bolts, or other standard connections. The mast 12 is commonly constructed of tubular aluminum, but may be of any suitable material, including concrete, steel or fiberglass. The mast 12 may also be of any selected cross section, including circular or square. The mast 12 is capable of supporting an electrical component 30. The electrical component 30 may be a standard street lamp 32, a high-watt high mast lighting system (not shown), or other desired device. An electrical cable 34 connects the electrical component 30 to a distribution component assembly 36. The electrical cable 34 is preferably sized for standard mast height and runs the length of the mast 12 through its hollow interior. Other embodiments of the electrical cable may be utilized, including commercially available mast lighting cables (not shown), or even a simple 3 wire cable having 14 gauge conductors (not shown).

The distribution component assembly 36 may be located within a chamber 38. Location of the distribution component assembly 36 within the chamber 38 may provide optimal protection from side impact damage due to traffic accidents or other collisions.

In one embodiment, the central conduit 22 may be constructed of pressure treated cylindrical PVC tubing or galvanized rigid steel piping of 6" diameter. In this embodiment, the central conduit 22 may have an access hole 40 there through to allow passage of the incoming and outgoing feeder wires 24, 26 into the chamber 38. The foundation 14 may form the lower boundary of the chamber 38. Horizontal rebar (not shown) may be provided extending into the surrounding pedestal 20 for securing the central conduit 22 after the concrete sets.

The distribution component assembly 36 may include, in one embodiment, a surge arrestor and one or more electrical connectors 44 (see FIGS. 2-5) which connect(s) the distribution component assembly 36 to the electrical cable 34. Individual components may be connected via standard wiring, with or without the use of contact blocks (not shown) mounted to a board (not shown). Standard fuses may be utilized, whether free standing or contained in an integrated externally accessible fusing assembly, described in further detail below. Commercially available components from a variety of manufacturers may be utilized in the distribution component assembly 36, such as fast-acting type axial fuses and surge arrestors.

The mast 12, near the proximate end 35 which may be above the foundation 14, defines an opening or handhole 42, through which the chamber 38 is accessible by the user. The handhole 42 may extend through the main body 72 of the mast 12 itself, or through a breakaway cover 46 on the mast 12 at its proximate end 35. The location of the opening or handhole 42 should be near enough to the foundation 14 and chamber 38 therein that the distribution component assembly 36 is accessible by hand to maintenance or installation personnel, thereby simplifying routine maintenance and repair to be performed on the mast lighting system 10. The handhole 42 may be covered between repairs or maintenance by the cover or door 46.

In one embodiment, the electrical connector 44 in the assembly 36 between the feed wires 24, 26 and the electrical cable 34 is a watertight breakaway connector. The breakaway connector 44 preferably disengages under tension, such as when a mast 12 fails due to vehicular impact. In any event, the tensile force required to disengage the breakaway connector 44 is less than the tensile force necessary to damage the electrical cable 34 or electrical connections thereto. When the breakaway connector is properly mated and locked, it preferably forms an enclosure which meets the local municipal and other requirements.

Figure 2:
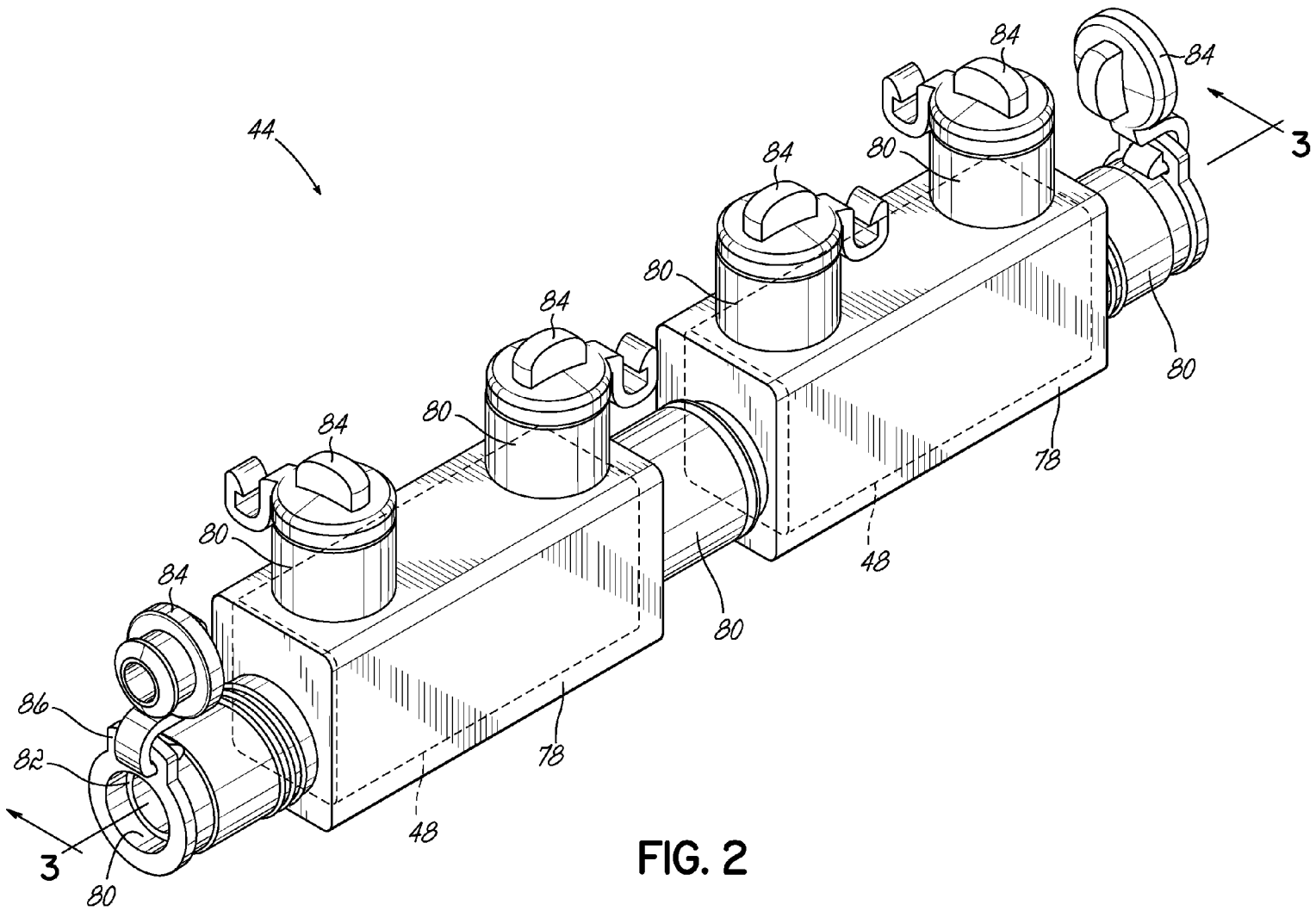
FIG. 2 is a perspective view of one embodiment of an electrical connector according to this invention.
Figure 3:
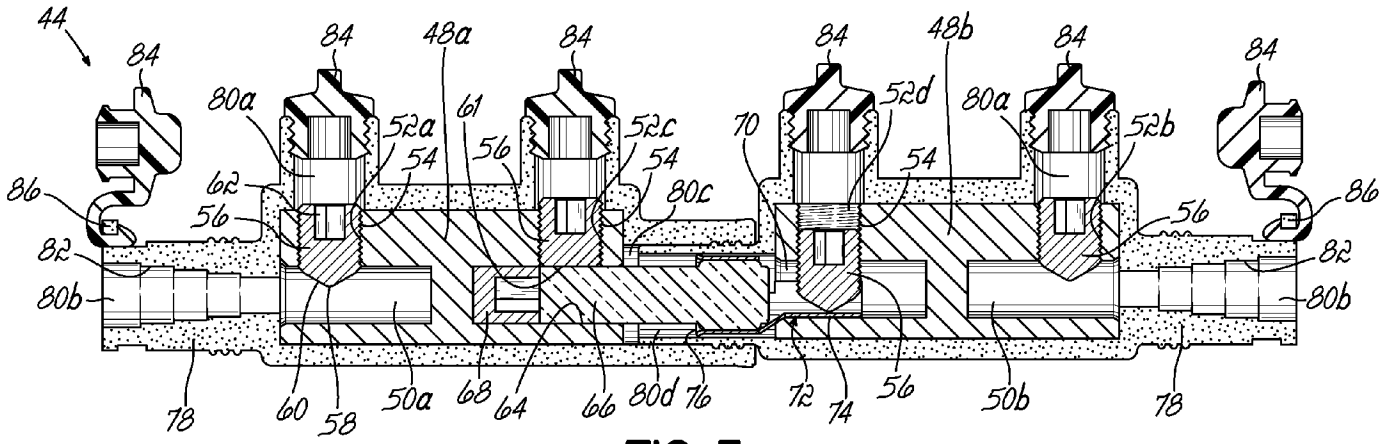
FIG. 3 is a cross-sectional view taken along line 3-3 of FIG. 2.
Figure 4:
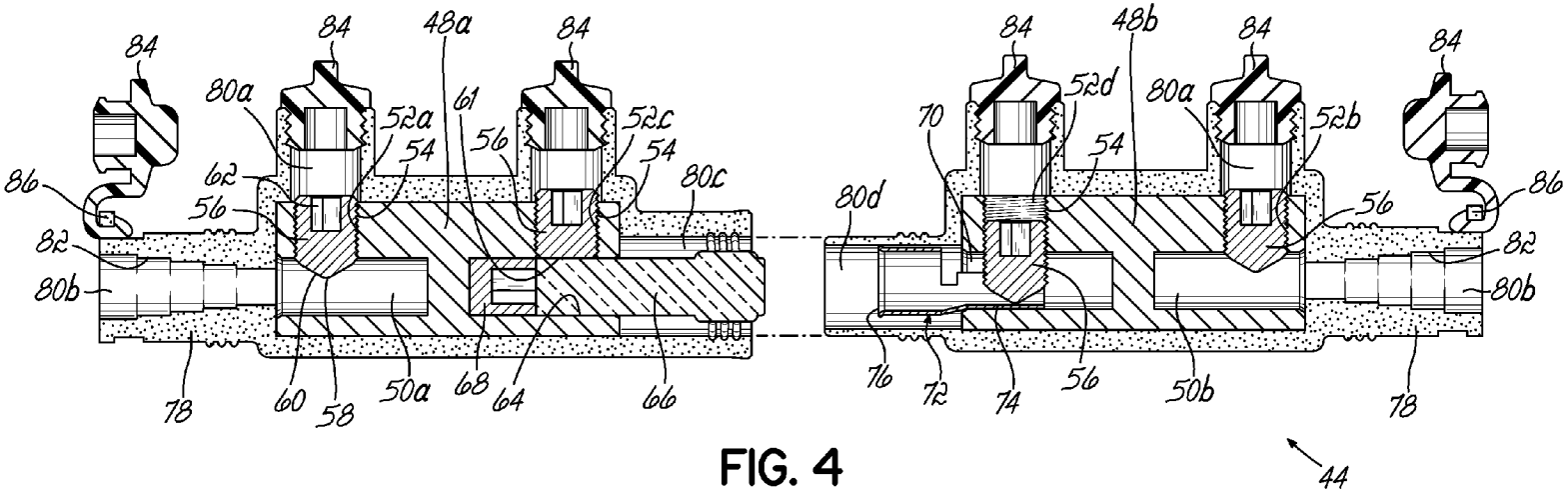
FIG. 4 is a view similar to FIG. 3 with the connector separated.
Figure 5:
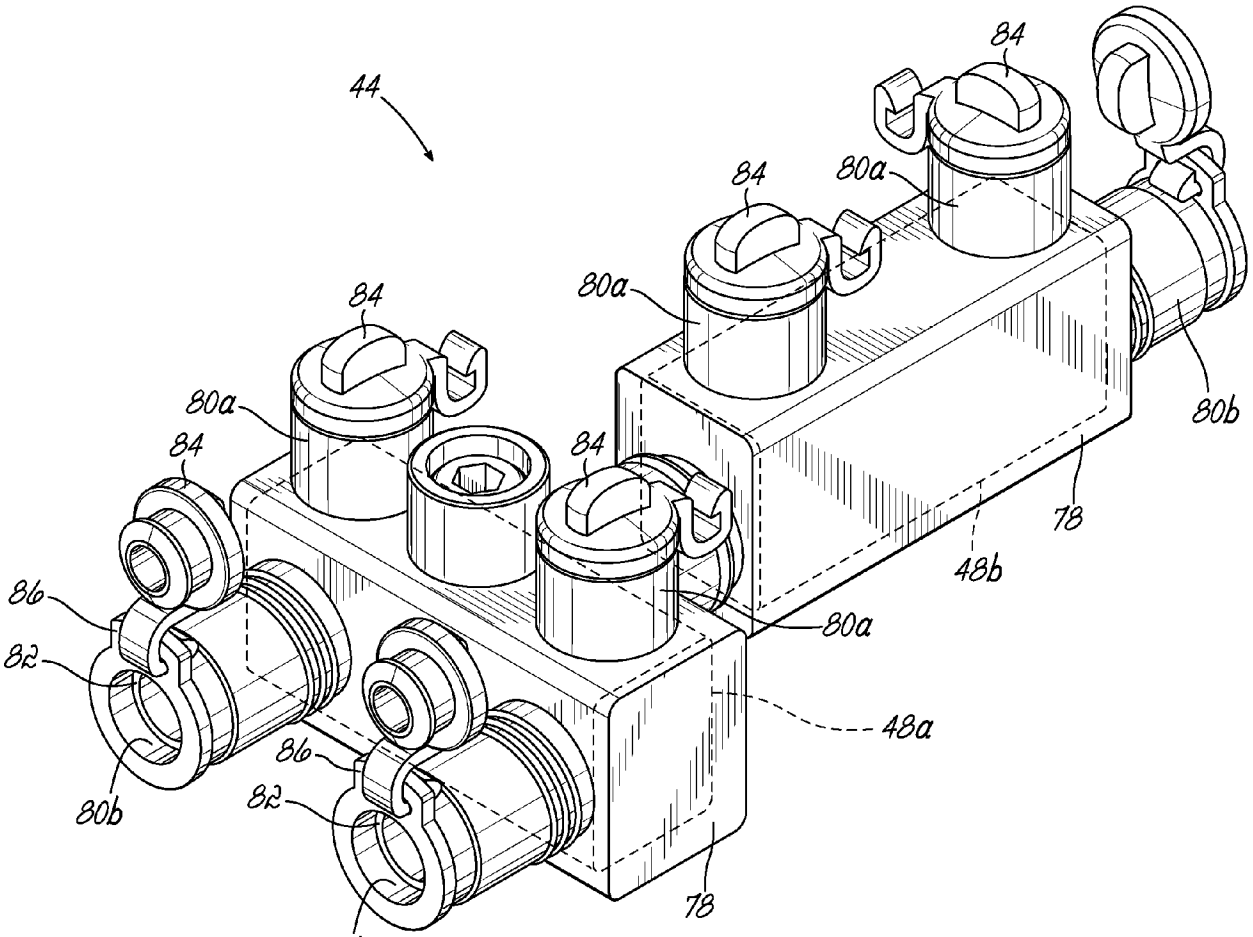
FIG. 5 is a perspective view of another embodiment of an electrical connector according to this invention.

Referring to FIGS. 2-5, various embodiments of a breakaway connector 44 according to this invention are shown. A first embodiment of the breakaway connector 44 is shown in FIGS. 2-4 and a second embodiment consistent with the principles of this invention is shown in FIG. 5. The first embodiment of FIGS. 2-4 of the breakaway connector 44 includes two rigid metal bodies 48*a*, 48*b*, (first and second parts) one of which is a load side metal body 48*a* and the other which is a line side metal body 48*b*. The load side metal body 48*a* is coupled to the electrical cable 34 extending through the mast coupled to the light or load 32. The metal body 48*b* on the line side is coupled to the incoming feeder wire 24 on the voltage side of the electrical connector 44. Each metal body 48 may include a top surface, a bottom surface and opposed sidewalls that are continuous with the top and bottom surfaces. In various embodiments, each metal body 48 has a substantially rectangular cross-sectional profile.

Each metal body 48 includes a conductor receiving bore 50 extending longitudinally into the metal body 48 on one end thereof. Each conductor receiving bore 50 is adapted to receive a stranded conductor or other wire. The stranded conductor may be the incoming feed wire 24 or the electrical cable 34 and if it is a stranded conductor comprises a compacted bundle of individual strands of an electrically-conducted material such as copper or aluminum. Each conductor receiving bore 50 is generally cylindrical and has a circular cross section of a radial dimension adequate to receive the conductor therein. Each conductor receiving bore 50 is disposed substantially orthogonally to the planes defined by the sidewalls of the metal body 48.

A threaded bore 52 extends downwardly through the top surface of each metal body 48 and communicates with the interior of the associated conductor receiving bore 50. A longitudinal axis of the threaded bore 52 is disposed substantially orthogonal to a longitudinal axis of the conductor receiving bore 50. The threaded bore 52 includes a continuous helical thread 54 disposed along a substantial portion of the interior surface of the bore 52. Each threaded bore 52*a*, 52*b* receives therein a binding fastener such as a binding screw 56 removably received within the threaded bore 52. Each binding screw 56 may include a generally conical tip 58 having a slightly blunted extremity of a small radius of curvature and an inclined surface 60 relative to the plane tangent to the blunted extremity so that the contacting strands of the stranded conductor will be induced to slidably deflect there along. In addition, the conical tip 58 encourages strands to rub together and remove oxidation from the surfaces thereof so that the quality of the electrical connection is improved.

To facilitate insertion into the threaded bore and subsequent tightening, the binding screw 56 has a shaped recess 62 for receiving a corresponding-shaped tool (not shown). Recess 62 and tool removably receivable therein may have a hex-type or Allen-type connection. Other configurations of binding screw 56 are possible such as a binding screw having a slotted head or a Phillips-type head which can be tightened with an ordinary screwdriver.

Each metal body 48 may be formed by extrusion or any other known method of metal fabrication. Each metal body 48 may be composed of an aluminum alloy and, for the sake of compatibility during thermal cycling, the binding screw 56 and the electrical connector 44 may be composed of similar aluminum alloys.

As shown in FIGS. 2-4, the load side metal body 48*a* also includes a second threaded bore 52*c* extending downwardly through the top surface of the metal body 48*a*. This threaded bore 52*c* is in communication with a fuse receiving bore 64 extending longitudinally from an opposite end of the metal body 48*a* on which the conductor receiving bore 50*a* is located. As the name implies, the fuse receiving bore 64 is adapted to receive one longitudinal end of a fuse 66 inserted therein as shown particularly in FIGS. 3-4. So as to properly position the fuse 66 seated within the fuse receiving bore 64 of the load side metal body 48*a*, the fuse receiving bore 64 may also house a plug 68 in the terminal end of the bore. The threaded bore 52*c* is in communication with the fuse receiving bore 64 and extends downwardly through the top surface of the metal body 48*a*. A longitudinal axis of the threaded bore 52*c* is disposed substantially orthogonal to a longitudinal axis of the fuse receiving bore 64 and includes a continuous helical thread 54 disposed along a substantial portion of the interior surface thereof. A binding screw 56 is removably received within the threaded bore 52*c* so as to selectively secure the fuse 66 to the load side metal body 48*a* when seated therein. The tip 61 of the binding screw 56 in the bore 52*c* may be blunt or flat for contact with the fuse 66.

A fuse clip receiving bore 70 is formed in the line side metal body 48*b* extending longitudinally from an end of the metal body 48*b* opposite from the conductor receiving bore Sob therein. A threaded bore 52*d* likewise extends downwardly through the top surface of the line side metal body 48*b* and communicates with the interior of the fuse clip receiving bore 70. A longitudinal axis of the threaded bore 52*d* is disposed substantially orthogonal to the longitudinal axis of the fuse clip receiving bore 70 and includes a continuous helical thread 54 disposed along a substantial portion of the interior surface thereof. A binding screw 56 is removably received within the threaded bore 52*d*. The binding screw 56 and fuse clip receiving bore 70 are adapted to selectively secure a fuse clip 72 in the fuse clip receiving bore 70 such that the fuse clip 72 extends longitudinally from the end of the line side metal body 48*b* as shown in FIGS. 3 and 4. The fuse clip 72 may have a generally tubular configuration with a longitudinally extending tang 74 projecting into the fuse clip receiving bore 70 on a bottom portion thereof opposite from the threaded bore 52*d*. The tang 74 may have a semi-circular cross-sectional shape so as to conform to the configuration of the fuse clip receiving bore 70 and still provide access for insertion of the binding screw 56 to secure the fuse clip 72 to the line side metal body 48*b*. The distal end of the fuse clip 72 has a generally annular configuration, projects from the metal body 48*b* and is adapted to receive an end of the fuse 66 projecting from the load side metal body 48*b* as shown in FIG. 3. The distal end of the fuse clip 72 includes an annular lip 76 which is compatible with an end of the fuse 66 extending from the fuse receiving bore 64 in the metal body 48*a*. The lip 76 on the fuse clip 72 mates with an annular shoulder on the fuse 66 as shown in FIG. 3 to thereby complete the electrical circuit between the electrical bodies 48 when the components of various embodiments of this invention are assembled as shown in FIG. 3.

Each of the metal bodies 48 may be encased in plastic, rubber or other protective and non-conducting coating 78 substantially enveloping the metal body 48 on all sides. The insulating cover may be of any color and in various embodiments is black or clear plastic. The coating 78 may be polyvinyl chloride and include passages 80 for receiving the conductors, binding screws, fuse and fuse clip components of the electrical connector 44 according to various embodiments of this invention. The passages Boa of the cover 78 are formed upwardly extending from the top face of the metal body 48 and aligned with the threaded bores 52 for the binding screws 56 to pass there through and into the threaded bores 52. The passages Bob on the longitudinal ends of the metal bodies 48 allow for the passage of the conductors into the conductor receiving bores 50. Passages 80*c*, Sod are for the fuse receiving bore 64 and the fuse clip receiving bore 70 as shown generally in FIGS. 3 and 4. The inner surfaces of the passages Bob in communication with the conductor receiving bores 50 may have a tiered step configuration 82, referred to as a rocket-shaped configuration in the industry, to receive and focus the strands of a multi-strand conductor being inserted therein and into the conductor receiving bore 50 of the metal body 48.

The shape, design and configuration of the passages 80*c*, 80*d* associated with the fuse receiving bore 64 and fuse clip receiving bore 70 on the compatible metal bodies 48*a*, 48*b* are intended for mating the metal bodies together as shown generally in FIG. 3. The male plug and female socket interconnection relationship between the passages 80*c*, 80*d* for the fuse on the fuse clip are shown particularly in FIG. 3. The male/female interconnection between the passages 80*c*, 80*d* on the fuse receiving bore 64 and fuse clip receiving bore 70 provide for a water-tight breakaway connection between the covers 78 surrounding the metal bodies 48. The connector 44 may also be sealed against salt and UV light by the cover 78. Moreover, each of the passages may include a cap 84 connected to a tether 86 coupled to the cover 78 for selectively closing and sealing the associated passage 80 thereby further providing for a moisture seal for the electrical connector 44. The various caps 84 associated with the passages 80 may be interchangeable such that one cap may be removed and reinstalled on a different passage on the same or different metal body 48.

Referring to FIG. 5, another embodiment of the connector 44 according to this invention is shown in which the load side metal body 48*a* is oriented generally perpendicular to the line side metal body 48*b*. The metal body 48*a* of this embodiment includes a pair of conductor receiving bores 50*a*, 50*a*, each of which is adapted to receive an electrical cable 34 with the fuse receiving bore 64 positioned therebetween. Each conductor receiving bore 50*a*, 50*a* has a passage 80 associated therewith for passage of the electrical cable 34 into the metal body 48*a*. In other embodiments of this invention, any number of conductor receiving bores 50*a* could be included on the metal body 48*a*. Similarly, multiple conductor receiving bores 50*b* could be included on the metal body 48*b* in alternative embodiments of this invention. Moreover, multiple fuses may be accommodated in various embodiments of the connector 44.

Figure 6:
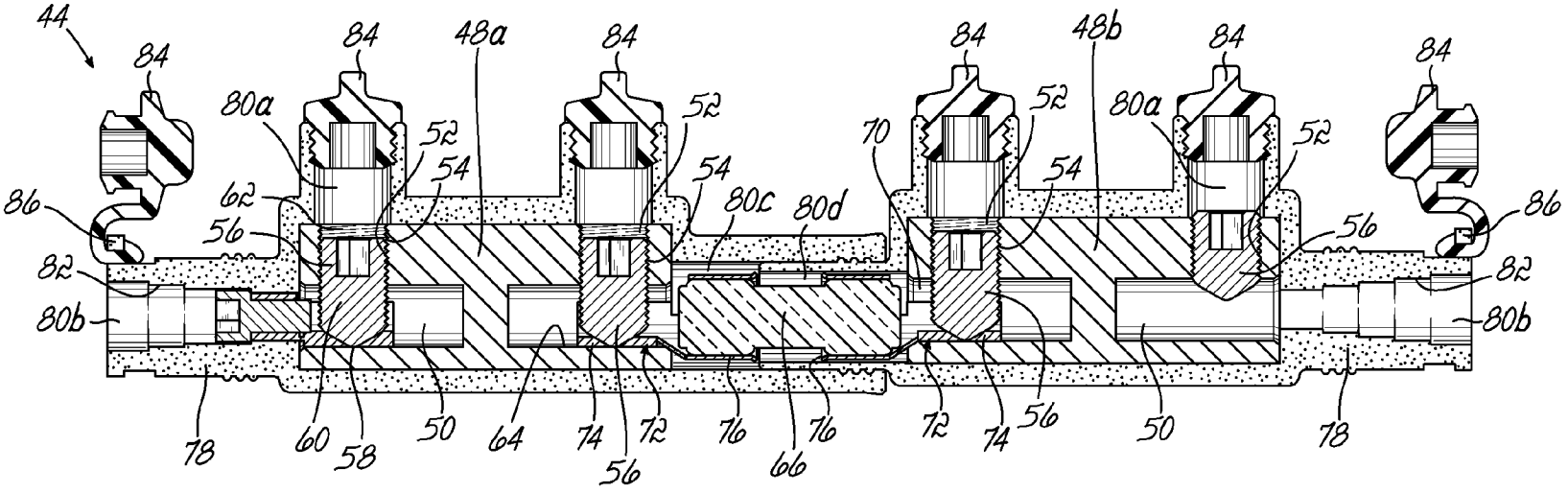
FIG. 6 is a view of a further alternative embodiment of the connector according to this invention.

A further alternative embodiment of the connector 44 according to this invention is shown in FIG. 6 which is similar to the view of the embodiment shown in FIG. 3. The embodiment of FIG. 6 includes two fuse clips 72, 72 each seated in one of the fuse related bores 64, 70 to retain the fuse 66 in the assembled connector 44. While each of the fuse clips 72 may be of similar design to one another, in some embodiments one of the fuse clips may include a feature to retain the fuse 66 with the associated portion of the connector 44 upon separation of the connector 44. The fuse 66 and each fuse clip 72 may be collectively or generally referred to herein as a fuse component. Each binding screw 56 in the respective body 48*a*, 48*b* may secure the tang 74 of the associated fuse clip 72 to the body 48*a*, 48*b* as shown in FIG. 6.

Use of a breakaway connector 44 in the mast lighting system 10 prevents broken wires and de-energization of a complete circuit when one component such as a mast 12 fails. The breakaway connector 44 separates safely under tension, eliminating danger and electrical shock. When it comes time to replace a failed mast 12, the existing electrical cable 34 can be re-used or replaced without replacing the underground feeder wires 24, 26 distribution component assembly 36 or the breakaway connector 44. A breakaway connector 44, which is rated for 15 amps, 480 volts, and which safely disengages under a tension of 7.5 lb may be employed. The connector 44 may disengage at the fuse juncture and/or at either or both conductor junctures.

While this invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of the general inventive concept.

What is claimed is:

1. A mast lighting system including at least one mast having a proximate end and an opposite distal end, the distal end capable of supporting an electrical component and the proximate end mounted to a foundation that has at least a portion extending into the ground, an electrical cable within the mast connecting the electrical component to an electrical connector and a power source, the system comprising:

a chamber of sufficient dimensions to receive the electrical connector therein, the electrical connector being disposed within the chamber;

an opening in the mast and adjacent the proximate end thereof, the opening being in communication with the chamber whereby the electrical connector is accessible by the user through the opening;

the electrical connector further comprising a breakaway electrical connector having a first part with a male plug and a second part with a female socket, and wherein the tensile force required to disengage the electrical connector is less than the tensile force necessary to damage the electrical cable or electrical connections to the electrical connector;

a fuse having a longitudinal axis and seated within at least one of the male plug and the female socket and contributing to a breakaway connection between the first and second parts of the electrical connector; and a fuse binding fastener adjustably coupled to one of the first and second parts and engaging the fuse in a direction generally perpendicular to the longitudinal axis to retain the fuse within the electrical connector.

2. The system of claim 1 further comprising:

a fuse clip situated in one of the first and second parts and releasably coupled to the fuse situated in the other one of the first and second parts, the fuse clip being adapted for breakaway connection to the fuse.

3. The system of claim 2 further comprising:

a first and a second fuse component receiving bore in the first and second parts, respectively, each fuse component receiving bore adapted to receive one of the fuse and the fuse clip therein for electrical connection.

4. The system of claim 1 further comprising:

a first and a second conductor receiving bore in the first and second parts, respectively, each conductor receiving bore adapted to receive a conductor therein for electrical connection to the electrical connector.

5. The system of claim 4 further comprising:

a first and a second binding bore in the first and second parts, respectively, each binding bore being in communication with the associated conductor receiving bore; and a first and a second binding fastener adapted to be releasably situated in the first and second binding bore, respectively, and to contact and releasably secure the conductor when situated in the associated conductor receiving bore.

6. The system of claim 1 further comprising:

a first and a second covering on the first and second parts, respectively, each covering insulating an exterior surface of the respective part.

7. The system of claim 6 wherein the male plug and the female socket are formed by the associated first and second covering.

8. The system of claim 6 further comprising:

a plurality of bores in each of the first and second parts, each of the bores being adapted to receive therein one of a conductor, a binding fastener, the fuse and a fuse clip; and a plurality of passages each in one of the first and the second coverings, each of the passages being in communication with one of the bores and providing access to one of the first and second parts.

9. The system of claim 8 further comprising:

a plurality of caps each coupled to one of the passages by one of a plurality of tethers, each cap being releasably fitted with a distal end of one of the passages to thereby selectively seal the passage when the cap is fitted therewith.

10. A mast lighting system including at least one mast having a proximate end and an opposite distal end, the distal end capable of supporting an electrical component and the proximate end mounted to a foundation that has at least a portion extending into the ground, an electrical cable within the mast connecting the electrical component to an electrical connector and a power source, the system comprising:

a chamber of sufficient dimensions to receive the electrical connector therein, the electrical connector being disposed within the chamber;

an opening in the mast and adjacent the proximate end thereof, the opening being in communication with the chamber whereby the electrical connector is accessible by the user through the opening;

the electrical connector further comprising a breakaway electrical connector having a first part with a male plug and a second part with a female socket, and wherein the tensile force required to disengage the electrical connector is less than the tensile force necessary to damage the electrical cable or electrical connections to the electrical connector;

a fuse seated within at least one of the male plug and the female socket and contributing to a breakaway connection between the first and second parts of the electrical connector;

a fuse clip situated in one of the first and second parts and releasably coupled to the fuse situated in the other one of the first and second parts, the fuse clip being adapted for breakaway connection to the fuse;

a first and a second fuse component receiving bore in the first and second parts, respectively, each fuse component receiving bore adapted to receive one of the fuse and the fuse clip therein for electrical connection;

a first and a second binding bore in the first and second parts, respectively, each binding bore being in communication with the associated fuse component receiving bore; and a first and a second binding fastener adapted to be releasably situated in the first and second binding bore, respectively, and to contact and releasably secure one of the fuse and the fuse clip when situated in the associated fuse component receiving bore.

11. A mast lighting system including at least one mast having a proximate end and an opposite distal end, the distal end capable of supporting an electrical component and the proximate end mounted to a foundation that has at least a portion extending into the ground, an electrical cable within the mast connecting the electrical component to a distribution component assembly through an electrical connector, and a power source connected to the distribution component assembly, the system comprising:

a chamber of sufficient dimensions to receive the distribution component assembly therein, the distribution component assembly being disposed within the chamber;

an opening in the mast and adjacent the proximate end thereof, the opening being in communication with the chamber whereby the distribution component assembly is accessible by the user through the opening;

the distribution component assembly further comprising a breakaway electrical connector having a first part with a male plug and a second part with a female socket, and wherein the tensile force required to disengage the breakaway electrical connector is less than the tensile force necessary to damage the electrical cable, the breakaway electrical connector or electrical connections thereto;

a fuse having a longitudinal axis and seated within at least one of the male plug and the female socket and contributing to a breakaway connection between the first and second parts of the breakaway electrical connector;

a fuse clip situated in one of the first and second parts and releasably coupled to the fuse situated in the other one of the first and second parts, the fuse clip being adapted for breakaway connection to the fuse;

a first and a second conductor receiving bore in the first and second parts, respectively, each conductor receiving bore adapted to receive a conductor therein for electrical connection to the breakaway electrical connector;

a first and a second binding bore in the first and second parts, respectively, each binding bore being in communication with the associated conductor receiving bore;

a first and a second binding fastener adapted to be releasably situated in the first and second binding bore, respectively, and to contact and releasably secure the conductor when situated in the associated conductor receiving bore;

a first and a second fuse component receiving bore in the first and second parts, respectively, each fuse component receiving bore adapted to receive one of the fuse and the fuse clip therein for electrical connection; and a fuse binding fastener adjustably coupled to one of the first and second parts and engaging the fuse in a direction generally perpendicular to the longitudinal axis to retain the fuse within the electrical connector.

12. The system of claim 11 further comprising:

a first and a second covering on the first and second parts, respectively, each covering insulating an exterior surface of the respective part, wherein the male plug and the female socket are formed by the associated first and second covering;

a plurality of passages each in one of the first and the second coverings, each of the passages being in communication with one of the bores and providing access to one of the first and second parts; and a plurality of caps each coupled to one of the passages by one of a plurality of tethers, each cap being releasably fitted with a distal end of one of the passages to thereby selectively seal the passage when the cap is fitted therewith.

13. A breakaway electrical connector for use in a mast lighting system including at least one mast having a proximate end and an opposite distal end, the distal end capable of supporting an electrical component and the proximate end mounted to a foundation that has at least a portion extending into the ground, an electrical cable within the mast connecting the electrical component to the breakaway electrical connector, and a power source connected to the breakaway electrical connector, the breakaway electrical connector comprising:

a first part with a male plug and a second part with a female socket, and wherein the tensile force required to disengage the breakaway electrical connector is less than the tensile force necessary to damage the electrical cable, the breakaway electrical connector or electrical connections thereto;

a fuse having a longitudinal axis and seated within at least one of the male plug and the female socket and contributing to a breakaway connection between the first and second parts of the breakaway electrical connector;

a fuse binding fastener adjustably coupled to one of the first and second parts and engaging the fuse in a direction generally perpendicular to the longitudinal axis to retain the fuse within the electrical connector.

14. The breakaway electrical connector of claim 13 further comprising:

a fuse clip situated in one of the first and second parts and releasably coupled to the fuse situated in the other one of the first and second parts, the fuse clip being adapted for breakaway connection to the fuse.

15. The breakaway electrical connector of claim 14 further comprising:

a first and a second fuse component receiving bore in the first and second parts, respectively, each fuse component receiving bore adapted to receive one of the fuse and the fuse clip therein for electrical connection.

16. The breakaway electrical connector of claim 13 further comprising:

a first and a second conductor receiving bore in the first and second parts, respectively, each conductor receiving bore adapted to receive a conductor therein for electrical connection to the breakaway electrical connector.

17. The breakaway electrical connector of claim 16 further comprising:

a first and a second binding bore in the first and second parts, respectively, each binding bore being in communication with the associated conductor receiving bore; and a first and a second binding fastener adapted to be releasably situated in the first and second binding bore, respectively, and to contact and releasably secure the conductor when situated in the associated conductor receiving bore.

18. The breakaway electrical connector of claim 13 further comprising:

a first and a second covering on the first and second parts, respectively, each covering insulating an exterior surface of the respective part.

19. The breakaway electrical connector of claim 18 wherein the male plug and the female socket are formed by the associated first and second covering.

20. The breakaway electrical connector of claim 18 further comprising:

a plurality of bores in each of the first and second parts, each of the bores being adapted to receive therein one of a conductor, a binding fastener, the fuse and a fuse clip; and a plurality of passages each in one of the first and the second coverings, each of the passages being in communication with one of the bores and providing access to one of the first and second parts.

21. The breakaway electrical connector of claim 20 further comprising:

a plurality of caps each coupled to one of the passages by one of a plurality of tethers, each cap being releasably fitted with a distal end of one of the passages to thereby selectively seal the passage when the cap is fitted therewith.

22. A breakaway electrical connector for use in a mast lighting system including at least one mast having a proximate end and an opposite distal end, the distal end capable of supporting an electrical component and the proximate end mounted to a foundation that has at least a portion extending into the ground, an electrical cable within the mast connecting the electrical component to the breakaway electrical connector, and a power source connected to the breakaway electrical connector, the breakaway electrical connector comprising:

a first part with a male plug and a second part with a female socket, and wherein the tensile force required to disengage the breakaway electrical connector is less than the tensile force necessary to damage the electrical cable, the breakaway electrical connector or electrical connections thereto;

a fuse seated within at least one of the male plug and the female socket and contributing to a breakaway connection between the first and second parts of the breakaway electrical connector;

a fuse clip situated in one of the first and second parts and releasably coupled to the fuse situated in the other one of the first and second parts, the fuse clip being adapted for breakaway connection to the fuse;

a first and a second fuse component receiving bore in the first and second parts, respectively, each fuse component receiving bore adapted to receive one of the fuse and the fuse clip therein for electrical connection;

a first and a second binding bore in the first and second parts, respectively, each binding bore being in communication with the associated fuse component receiving bore; and a first and a second binding fastener adapted to be releasably situated in the first and second binding bore, respectively, and to contact and releasably secure one of the fuse and the fuse clip when situated in the associated fuse component receiving bore.

* * * * *